US011035533B1

(12) United States Patent
Rojas

(10) Patent No.: US 11,035,533 B1
(45) Date of Patent: Jun. 15, 2021

(54) BENDABLE LAMP

(71) Applicant: Paul J Rojas, Mill Valley, CA (US)

(72) Inventor: Paul J Rojas, Mill Valley, CA (US)

( * ) Notice: Subject to any disclaimer, the term of this patent is extended or adjusted under 35 U.S.C. 154(b) by 0 days.

(21) Appl. No.: 17/065,469

(22) Filed: Oct. 7, 2020

(51) Int. Cl.
*F21S 6/00* (2006.01)
*F21V 21/32* (2006.01)
*F21Y 115/10* (2016.01)

(52) U.S. Cl.
CPC ..... *F21S 6/002* (2013.01); *F21V 21/32* (2013.01); *F21Y 2115/10* (2016.08)

(58) Field of Classification Search
CPC ..... F21V 1/00; F21V 1/06; F21V 1/08; F21V 1/22; F21V 21/32; F21S 6/002; F21S 4/22; F21Y 2115/10; F21Y 2107/30; F21L 4/00
See application file for complete search history.

(56) References Cited

U.S. PATENT DOCUMENTS 7,210,818 B2 * 5/2007 Luk ..... H05B 45/20 362/231
10,317,022 B2 * 6/2019 Tannahill ..... F21S 4/22
2015/0198307 A1 * 7/2015 Brand ..... G02B 6/0006 362/555
2016/0258607 A1 * 9/2016 Carton ..... F21V 21/32
2016/0290605 A1 * 10/2016 Haskal ..... F21V 7/00
2021/0061424 A1 * 3/2021 Popa ..... F21V 21/26

FOREIGN PATENT DOCUMENTS

EP 1612470 * 1/2006 ..... F21S 4/00
GB 2458380 * 9/2009 ..... F21S 8/04

* cited by examiner

*Primary Examiner* — Peggy A Neils
(74) *Attorney, Agent, or Firm* — Ivan E. Rozek; Savantek Patent Services

(57) ABSTRACT

A bendable lamp that includes an open topped base with an upwardly projecting LED lighting source. A translucent accordion bellows sleeve is attached at one end to the open topped base. The sleeve can be vertically extended or retracted by the user. The nature of the pleats of the accordion sleeve allow the resulting structure to remain in the position that the user pulled, compressed or bent it to. The sleeve can be bent to an inverted J or inverted U shape, and its height can be adjusted. A weight in the lamp's base keeps the lamp from falling over. The LED lights can be programmed by a microprocessor.

8 Claims, 6 Drawing Sheets

BENDABLE LAMP

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of specialty portable lamps and more specifically to a bendable lamp.

Decorative lamps for household use or camping use have been in existence for over one hundred years. Most household lamps include some sort of base which supports a light source such as a light bulb, and a translucent lamp shade that covers the light bulb yet allows light to extend out to the rest of the environment.

In most cases, the lamp shade itself is not expandable or retractable or bendable, although there are many mechanical frame assemblies that have been designed to adjust the height or position of a lighting source. A few pneumatic lamps have been produced which are balloon type structures that can change shape according how much air is introduced, and one Brazilian patent BR 202018005123-2 U2 shows a translucent plastic tube with lights placed inside it.

None of the prior designs depicts an accordion type bellows sleeve that can be vertically extended or contracted or bent to shape by a user where the sleeve retains its shape without need of any additional supporting structure.

BRIEF SUMMARY OF THE INVENTION

The primary object of the invention is to provide a bendable lamp that allows the user to quickly and easily adjust the lamp's height or angle without needing special hardware or supporting structures.

Another object of the invention is to provide a bendable lamp that incorporates programmable LEDs to project lighting effects onto the inner surface of the lamp which shine through to the surrounding environment.

Another object of the invention is to provide a bendable lamp that holds its shape after the user has adjusted the lamp to the desired length or bent condition.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a bendable lamp comprising: a base housing; an accordion bellows sleeve member; a counter weight; a lighting source; a cord and plug; said base housing including an aperture that is equal in diameter to the diameter of said accordion bellows sleeve member; said lighting source centrally located within said base housing;

said counter weight being approximately doughnut shaped and surrounding said lighting source; said bellows type sleeve member fixedly attached at one end to said base housing; said accordion bellows type sleeve member having a helical wire frame attached to a thin translucent plastic material having a plurality of circumferential accordion pleats; and said accordion pleats capable of being compressed forming a cylindrical shape where said wire frame is in a compressed position or being extended to form a said accordion bellows where said wire frame is in an extended position.

said accordion pleats capable of retaining their compressed or extended condition until reset by a user and said lighting source powered by electrical power source via said cord and plug.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
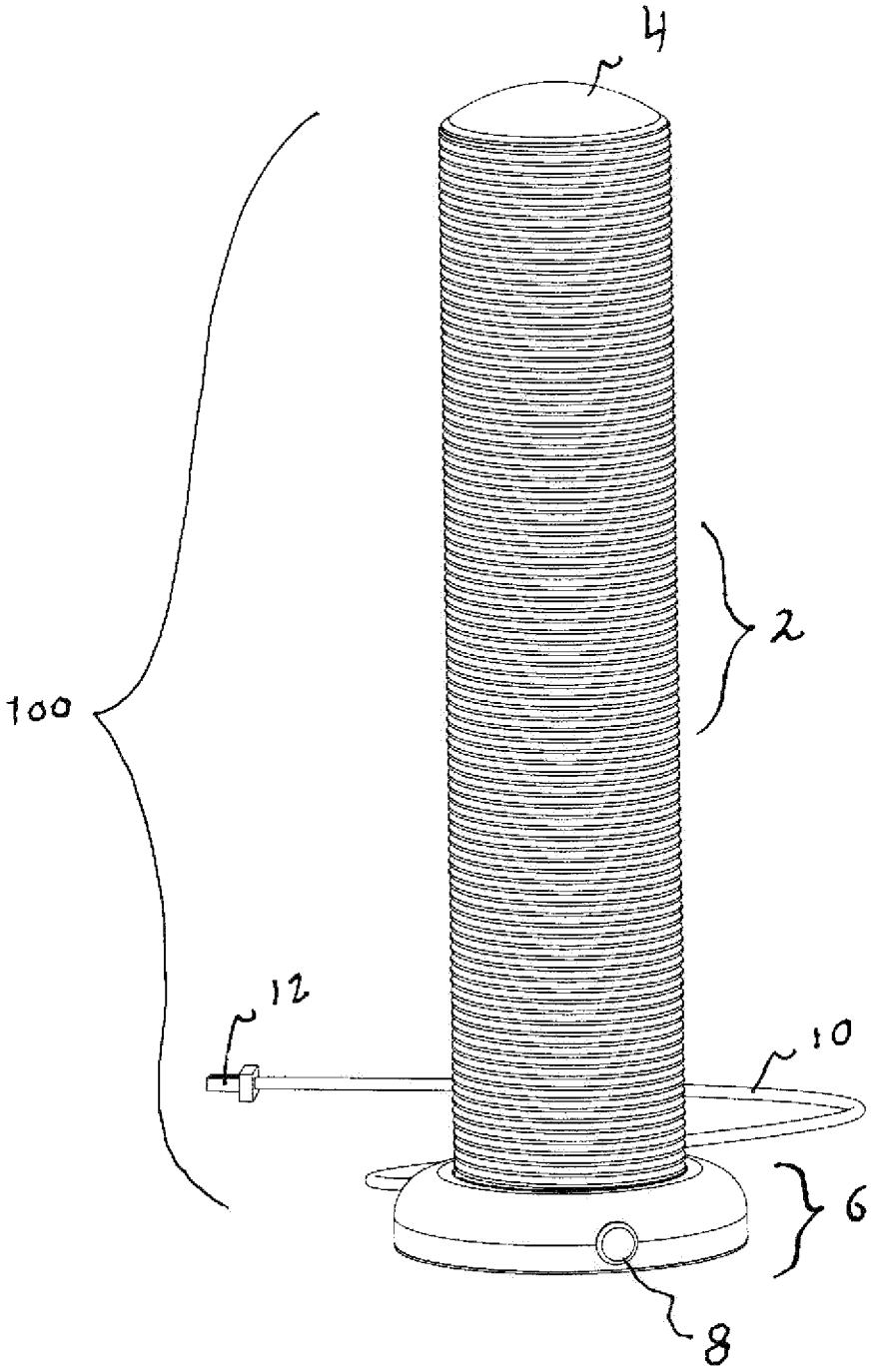
FIG. 1 is a perspective view of the invention with the bellows sleeve in the vertical position

Referring now to FIG. 1 we see a perspective view of the invention 100 with cylindrically shaped accordion bellows sleeve 2 in the vertical position and the pleats of the bellows sleeve 2 in the extended position. For simplicity, the accordion bellows sleeve 2 will be referred to as the sleeve 2 or the bellows sleeve 2. In the preferred embodiment the diameter of the sleeve 2 is approximately five inches. The construction of the bellows sleeve 2 includes a plurality of accordion members formed by helical steel wire 18 having a cross section dimension of approximately fifty thousandths of an inch, and bellows sleeve 2 made of translucent resilient plastic approximately eighteen thousandths of an inch thick. The wire 18 is embedded into the sleeve 2 as shown in the section view in FIGS. 4 and 5. The sleeve 2 is attached to hollow housing 6. A switch 8 can turn on or off an LED lighting display 16 as shown in the section view in FIG. 4. The construction of the sleeve 2 allows it to remain in a vertical position without any assistance from a support structure. Top member 4 encloses the sleeve 2. The sleeve 2 becomes illuminated via LED light source 16 creating decorative lit patterns on the inner surface and outer surface of the sleeve 2 and also shines out to the surrounding environment. The top member 4 includes a downward facing mirror 22 shown in the exploded view of the invention in FIG. 6. The mirror 4 reflects the LED light downward to increase the illuminating effect of the sleeve 2. Alternately, the top member 2 can be removed, causing the LED light to continue upward toward the ceiling of a room. A microprocessor within the LED light assembly 16 can create a variety of light patterns and colors which can be controlled by the user via switch 8 or other standard means including a wireless phone app that can be received by a standard W-Fi receiver contained within the base housing 6. The LED light assembly 16 is powered by cord 10 a plug 12 which can plug into a standard one hundred- and ten-volt AC house or office outlet. Alternately, the LED light assembly 16 may be powered by a rechargeable battery stored within the base housing 6.

Figure 2:
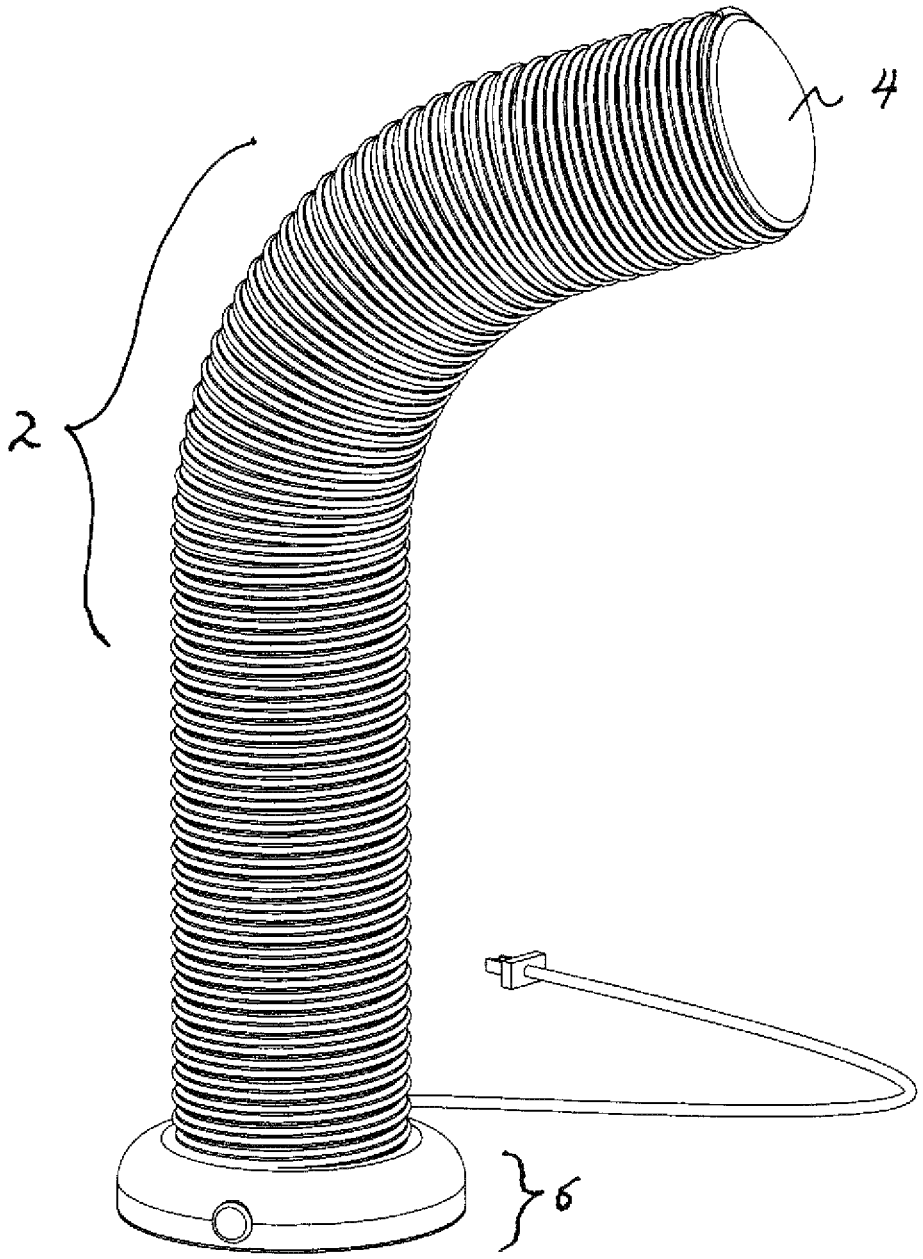
FIG. 2 is a perspective view of the invention with the bellows sleeve in an inverted J position.
Figure 4:
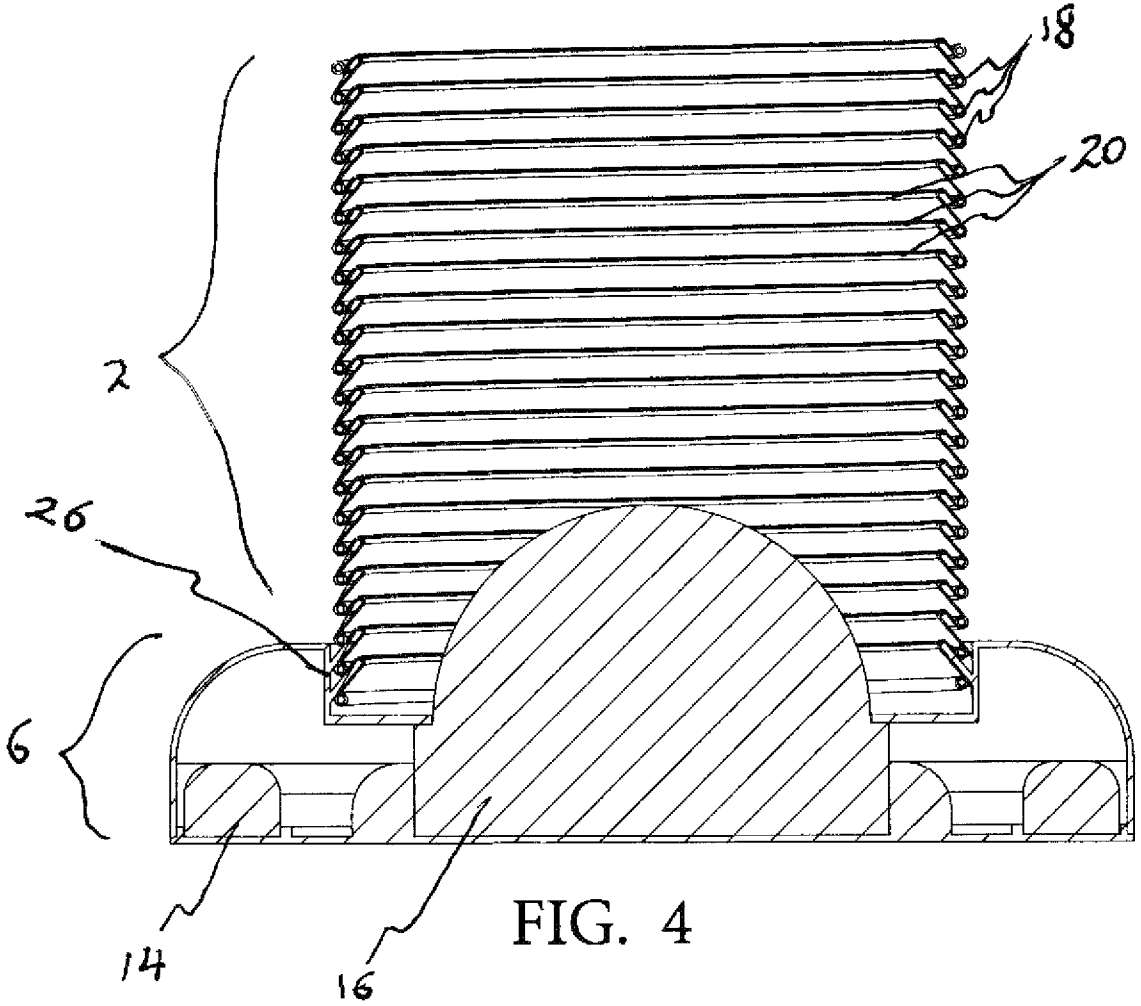
FIG. 4 is a partial section view of the base portion of the bellows sleeve.

FIG. 2 is a perspective view of the invention 100 where the sleeve 2 has been bent into an inverted J position. The nature of the bellows construction allows the sleeve 2 to remain in the shape that the user has set it to without need for additional structural support. The sleeve 2 may also be bent into an inverted U shape. Weight member 14 as shown in the section view in FIG. 4 is approximately doughnut shaped allowing the LED light assembly 16 to sit within the doughnut shape. The weight member 14 provides stability for the lamp 100 even when the top portion of the sleeve 2 is bent to the right or left. The weight 14 may be made of steel, lead, sand, or any other material that lends weight to the perimeter of the base 6.

Figure 3:
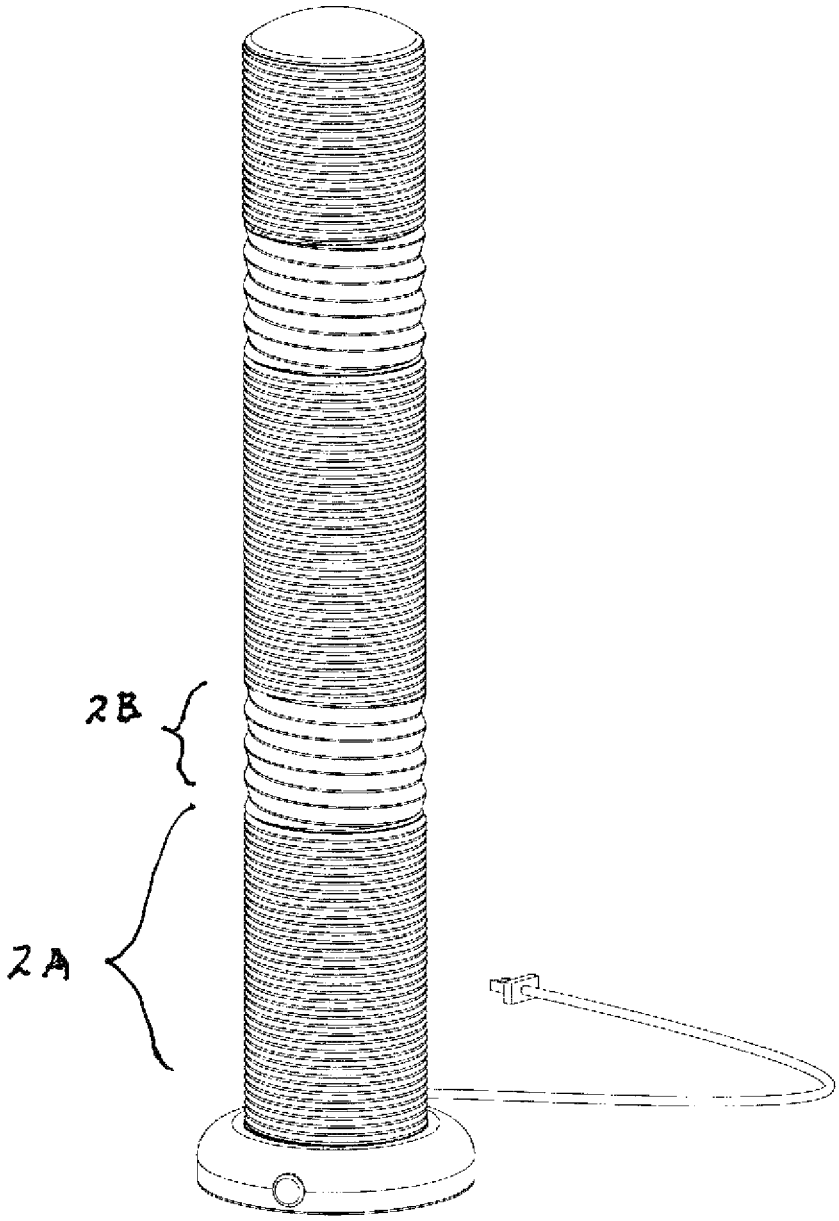
FIG. 3 is a perspective view of the invention with the bellows sleeve partially contracted in portions.

FIG. 3 is a perspective view of the invention 100 with portions of the sleeve in the compressed position 2A and portions of the sleeve in the extended position 2B. This feature allows the user to produce even more variations of the sleeve 2 design which also produce different lighting effects than a fully extended sleeve 2 would.

FIG. 4 is a section view of the base 6 portion of the invention 100 showing that the base includes an aperture at its top surface that is equal to the diameter of bellows sleeve 2 which is fixedly attached to the base via indented portion 26. The LED lighting assembly 16 may be similar to pulsating and moving party light assemblies that are currently on the market such as "Disco Ball Party Lights Portable Rotating Lights Sound Activated LED Strobe Light 7 Color display" available on Amazon.com. FIG. 4 shows the sleeve 2 in its contracted position where helical wire 18 is contracted as much as the bellows portion 20 will allow. Due to the nature of the construction of the bellows 20 and wire 18, the sleeve 2 remains compressed without any external structure holding it down.

Figure 5:
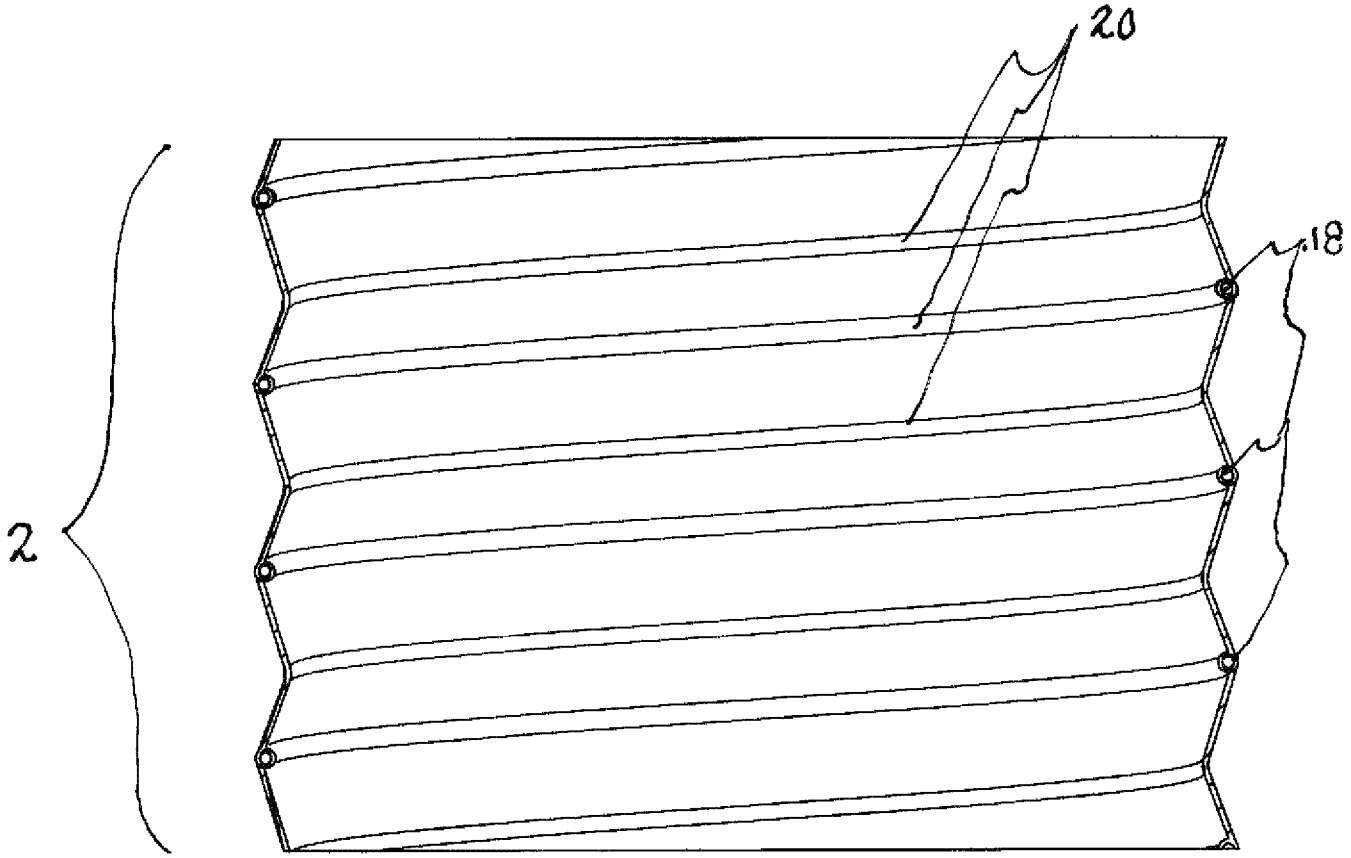
FIG. 5 is a partial section view of the bellows sleeve in the extended position.

FIG. 5 is an enlarged section view of the sleeve 2 in the extended position. The sleeve 2 bellows consist of inward and outward pleats that are strong enough to cause the sleeve 2 to remain in the extended position without need for external support, allowing the bellows sleeve 2 to remain in a vertical or bent position indefinitely until the user decides to change the sleeve's 2 appearance by extending it, retracting it or bending it.

Figure 6:
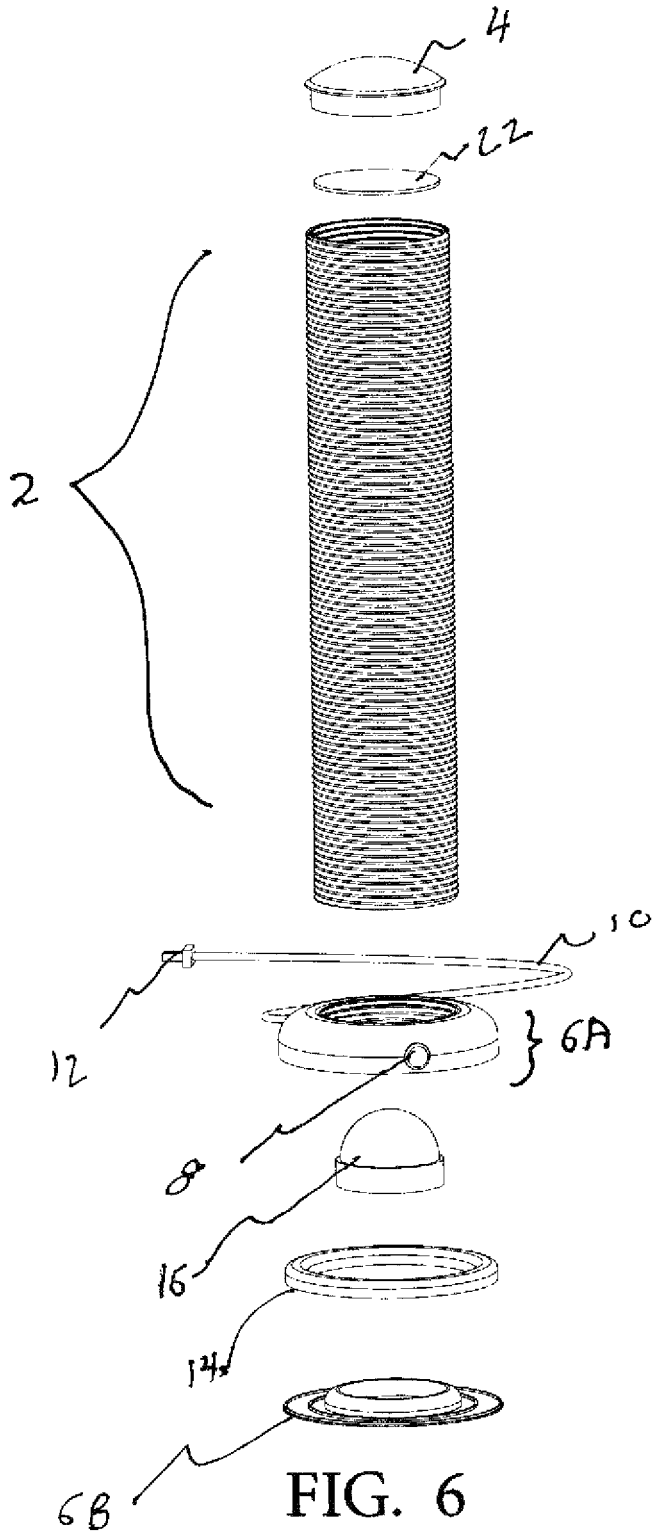
FIG. 6 is an exploded view of the invention.

FIG. 6 is an exploded view of the invention. Top member 4 is removable and replaceable. Mirror 22 mounts to the underside of the top member 4 allowing it to reflect light downward thereby increasing the brightness of the sleeve 2 during use. Base 6 is comprised of a top member 6A and a bottom plate 6B that attach to each other at their perimeter edges to form the completed base 6.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A bendable lamp comprising:

a base housing;

an accordion bellows sleeve member;

a counter weight;

a lighting source;

a power source for the said lighting source;

said base housing including an aperture that is equal in diameter to the diameter of said accordion bellows sleeve member;

said lighting source centrally located within said base housing;

said counter weight being approximately doughnut shaped and surrounding said lighting source;

said accordion bellows sleeve member fixedly attached at one end to said base housing;

said accordion bellows sleeve member having a helical wire frame surrounded by a translucent plastic material having a plurality of circumferential accordion pleats; and said accordion pleats capable of being compressed forming a cylindrical shape where said wire frame is in a compressed position or being extended to form a taller said accordion bellows where said wire frame is in an extended position;

said accordion pleats capable of retaining their compressed or extended condition until reset by a user.

2. A bendable lamp as claimed in claim 1 wherein said lighting source is a plurality of LED lamps projecting upward to provide illumination to the inside of said translucent plastic accordion bellows sleeve member and extending out to the surrounding environment.

3. A bendable lamp as claimed in claim 1 wherein said accordion bellows type sleeve member can be bent by the user to form an inverted J shape or an inverted U shape.

4. A bendable lamp as claimed in claim 1 further comprising a top lid that encloses the top portion of said accordion bellows sleeve member.

5. A bendable lamp as claimed in claim 4 wherein the underside of said top lid includes a reflecting mirror disk.

6. A bendable lamp as claimed in claim 2 wherein said plurality of LED lamps are programmed to create a variety of lighting displays by use of a microprocessor.

7. A bendable lamp as claimed in claim 1 wherein said power source for the said lighting source is at least one of a rechargeable DC battery power supply located within said base housing or a cord and plug.

8. A bendable lamp as claimed in claim 1 wherein said accordion bellows sleeve member is approximately five inches in diameter.

* * * * *